US010283900B2

(12) United States Patent
Herbrechtsmeier et al.

(10) Patent No.: US 10,283,900 B2
(45) **Date of Patent: *May 7, 2019**

(54) HOLDING FRAME FOR PLUG CONNECTOR MODULES THAT IS FIXABLE IN DIFFERENT ANGULAR POSITIONS

(71) Applicant: Harting Electric GmbH & Co. KG, Espelkamp (DE)

(72) Inventors: Heiko Herbrechtsmeier, Bünde (DE); Heiko Meier, Minden (DE); Alexander Schönfeld, Osnabrück (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/755,887

(22) PCT Filed: Aug. 17, 2016

(86) PCT No.: PCT/DE2016/100369

§ 371 (c)(1),
(2) Date: Feb. 27, 2018

(87) PCT Pub. No.: WO2017/036448

PCT Pub. Date: Mar. 9, 2017

(65) Prior Publication Data

US 2018/0254578 A1 Sep. 6, 2018

(30) Foreign Application Priority Data

Sep. 3, 2015 (DE) ..... 10 2015 114 703

(51) Int. Cl.
*H01R 13/502* (2006.01)
*H01R 13/518* (2006.01)
(Continued)

(52) U.S. Cl.
CPC ..... *H01R 13/518* (2013.01); *H01R 13/506* (2013.01); *H01R 13/508* (2013.01); *H01R 13/5045* (2013.01); *H01R 13/514* (2013.01)

(58) Field of Classification Search
CPC ..... H01R 13/514
(Continued)

(56) References Cited

U.S. PATENT DOCUMENTS 3,160,280 A 12/1964 Burch
4,693,440 A 9/1987 Lalonde
(Continued)

FOREIGN PATENT DOCUMENTS

CN 201656162 U 11/2010
CN 202084755 U 12/2011
(Continued)

OTHER PUBLICATIONS

Harting Elektronik GmbH, "Schwere Steckverbinder Han-Modular®," Product Catalog, Jan. 1999, 44 pages.
(Continued)

*Primary Examiner* — Phuong K Dinh
(74) *Attorney, Agent, or Firm* — Seed IP Law Group LLP

(57) ABSTRACT

The disclosure relates to a holding frame into which plug connector modules can be inserted, wherein the holding frame comprises or consists of two halves connectable to one another, wherein the halves can be aligned in at least two positions relative to one another, wherein the holding frame has at least one fixing means and wherein the halves can be fixed in at least two positions relative to one another via the at least one fixing means. At least one press projection or lug, preferably, however, two press projections or lugs is/are molded on the first half. The second half has two recesses on one end face or two recesses on two end faces respectively, and the press projection or lug can be pressed into the two
(Continued)

recesses or the press projections or lugs can be pressed into the two recesses respectively, as a result of which the halves can be fixed relative to one another in at least two positions, an open position and a closed position.

9 Claims, 3 Drawing Sheets

(51) Int. Cl.
*H01R 13/506* (2006.01)
*H01R 13/508* (2006.01)
*H01R 13/504* (2006.01)
*H01R 13/514* (2006.01)

(58) Field of Classification Search
USPC ..... 439/701, 540.1
See application file for complete search history.

(56) References Cited

U.S. PATENT DOCUMENTS

| | | | | |
|---|---|---|---|---|
| 5,529,426 | A | 6/1996 | Masuda et al. | |
| 5,829,910 | A | 11/1998 | Kameyama | |
| 6,004,162 | A * | 12/1999 | Harting | H01R 13/518 439/532 |
| 6,196,869 | B1 | 3/2001 | Kay et al. | |
| 6,350,141 | B1 | 2/2002 | Houtz | |
| 6,692,310 | B2 | 2/2004 | Zaderej et al. | |
| 7,066,677 | B2 | 6/2006 | Rüter | |
| 7,753,701 | B2 | 7/2010 | Tsuji | |
| 7,896,694 | B2 | 3/2011 | Schumann et al. | |
| 8,292,676 | B2 | 10/2012 | Schmidt et al. | |
| 8,449,314 | B1 | 5/2013 | Feist et al. | |
| 8,668,530 | B2 | 3/2014 | Riepe et al. | |
| 8,821,186 | B2 | 9/2014 | Lan | |
| 8,979,568 | B2 | 3/2015 | Herbrechtsmeier et al. | |
| 9,502,813 | B2 | 11/2016 | Dugo | |
| 9,577,365 | B1 * | 2/2017 | Herbrechtsmeier | H01R 13/518 |
| 9,608,374 | B2 | 3/2017 | Beischer et al. | |
| 9,847,608 | B2 | 12/2017 | Bruex et al. | |
| 9,923,307 | B2 | 3/2018 | Beischer et al. | |
| 2005/0070146 | A1 | 3/2005 | Lu | |
| 2006/0035501 | A1 | 2/2006 | Lewis et al. | |
| 2007/0155252 | A1 | 7/2007 | Ferderer | |
| 2010/0159728 | A1 | 6/2010 | Wang et al. | |
| 2014/0179171 | A1 | 6/2014 | Mortun et al. | |
| 2018/0026405 | A1 | 1/2018 | Schlepp et al. | |
| 2018/0241149 | A1 | 8/2018 | Herbrechtsmeier et al. | |
| 2018/0248296 | A1 | 8/2018 | Herbrechtsmeier et al. | |
| 2018/0248297 | A1 | 8/2018 | Herbrechtsmeier et al. | |
| 2018/0248298 | A1 | 8/2018 | Schönfeld et al. | |
| 2018/0254576 | A1 | 9/2018 | Herbrechtsmeier et al. | |
| 2018/0254577 | A1 | 9/2018 | Herbrechtsmeier et al. | |
| 2018/0269621 | A1 | 9/2018 | Schönfeld | |
| 2018/0277978 | A1 | 9/2018 | Schönfeld et al. | |

FOREIGN PATENT DOCUMENTS

| | | | |
|---|---|---|---|
| CN | 202352910 | U | 7/2012 |
| CN | 104466562 | A | 3/2015 |
| CN | 204205152 | U | 3/2015 |
| CN | 204271392 | U | 4/2015 |
| DE | 197 07 120 | C1 | 6/1998 |
| DE | 197 45 384 | A1 | 4/1999 |
| DE | 20 2005 020 026 | U1 | 4/2006 |
| DE | 20 2012 103 360 | U1 | 3/2013 |
| DE | 20 2013 103 611 | U1 | 11/2013 |
| DE | 10 2013 106 279 | A1 | 12/2014 |
| DE | 10 2015 101 433 | B3 | 6/2016 |
| EP | 0 843 384 | A2 | 5/1998 |
| EP | 2 581 991 | A2 | 4/2013 |
| FR | 2 860 348 | A1 | 4/2005 |
| GB | 1 394 867 | A | 5/1975 |
| WO | 2014/155171 | A1 | 10/2014 |

OTHER PUBLICATIONS

International Preliminary Report on Patentability, dated Mar. 6, 2018, for International Application PCT/DE2016/100369, 13 pages. (with English Translation).

Written Opinion of the International Search Authority, dated Oct. 31, 2016, for International Application No. PCT/DE2016/100369, 6 pages. (English Translation).

German Office Action, dated Aug. 5, 2016, for German Application No. 10 2015 114 703.3, 4 pages (no English translation provided).

International Search Report and Written Opinion, dated Oct. 31, 2016, for International Application No. PCT/DE2016/100369, 9 pages (with English translation of Search Report).

* cited by examiner

HOLDING FRAME FOR PLUG CONNECTOR MODULES THAT IS FIXABLE IN DIFFERENT ANGULAR POSITIONS

BACKGROUND

Technical Field

The disclosure relates to a holding frame for plug connector modules. Such holding frames serve for supporting plug connector modules, the holding frame being fitted with various plug connector modules and then being inserted into a plug connector housing and being screw-connected to said plug connector housing. In this case, the holding frame has to be mechanically robust in order to be able to withstand the insertion and withdrawal forces occurring when the plug connection is connected or disconnected.

Description of the Related Art

DE 19 707 120 C1 discloses a holding frame for plug connector modules. The holding frame consists of two halves which are interconnected by means of a joint. Latching hooks of the plug connector modules engage in recesses of the side faces of the respective half. The joint or the end-face joints are arranged in the fastening ends of the holding frame. When the holding frame is screwed onto a fastening face, the frame parts are aligned in such a manner that the side parts of the holding frame are aligned at right angles to the fastening face. As a result, the plug connector modules are fixed in the holding frame.

The holding frame of DE 19 707 120 C1 has no clearly defined open position for fitting the holding frame with plug connector modules. Consequently, on occasion, assembly is somewhat unwieldy, in particular in the case of untrained persons.

Once the holding frame has been successfully fitted with plug connector modules, it has to be moved into a closed state or into a closed position so that the plug connector modules are fixed. There is no fixed closed state for the closed state of the holding frame of the prior art such that the holding frame can inadvertently open, as a result of which the modules are able to fall out of their securement.

No defined electric contact exists between the halves of the holding frame as a result of a mere flexible connection. As a result, the holding frame is unable to be utilized for grounding purposes.

CN 204 205 152 U shows a holding frame which consists of two halves which are interconnected in a flexible manner. The halves can be moved—for fitting the holding frame with plug connector modules—into an open angular position. In this connection, work has to be undertaken against the force of a spring. Once the halves have been fitted, the resetting force of the spring pulls the halves 1, 2 back into a closed position again.

CN 201 656 162 U shows a holding frame which consists of two halves which are interconnected in a linear manner by means of a spring. The halves can be pulled—for fitting the holding frame with plug connector modules—in a linear manner into an open position. In this connection, work has to be undertaken against the force of a spring. Once the halves have been fitted, the resetting force of the spring pulls the halves back into a closed position.

Working against the spring makes the process of fitting the holding frame difficult as, on the one hand, the halves have to be fixed manually and, at the same time, the plug connector modules have to be inserted.

DE 20 2012 103 360 U1 shows a holding frame which consists of two halves which, as a result of displacing the one frame half in a linear manner relative to the other frame half, are latchable together in two different latching positions. However, when being fitted, it is possible for the plug connector modules to fall through a linearly opened holding frame.

BRIEF SUMMARY

Embodiments of the present invention provide a holding frame which is simple to handle and is versatile in use.

The holding frame according to an embodiment of the invention is provided for the purpose of receiving plug connector modules. The holding frame is then installed into a plug connector housing or screwed onto a wall surface, for example of a machine.

The holding frame comprises or consists of two interconnectable halves. Each of said halves comprises a side face and an end face. The two halves define, more or less in their contact region, a separation plane which extends parallel to the longitudinal sides of the halves.

The halves are alignable with respect to one another in at least two positions. As a rule, the ability to align is realized by a flexible connection, which is described in more detail further below.

The holding frame comprises or consists of said two flexibly interconnectable halves. The halves are alignable with respect to one another in at least two different angular positions by the flexible connection. The term angular position means that the planes of the individual halves enclose an angle which alters depending on the position of the halves with respect to one another.

The holding frame comprises means by way of which the halves are fixable both in an open position and in a closed position. Said means can be realized in diverse ways. Advantageous variants of the holding frame are described below in detail.

The holding frame comprises at least one fixing means or device and the halves are fixable with respect to one another in at least two positions, the open position and the closed position, by the at least one fixing means or device. In the open position, the holding frame can be fitted with the plug connector modules. In the closed position, the plug connector modules are fixed in the holding frame and are no longer able to slip or fall out, for example when installing the holding frame into a plug connector housing.

The term open position means that the halves are positioned with respect to one another along the separation line at an angle $\alpha$ not equal to 180°. The angle is preferably between 130° and 170°. An angle between 155° and 165° has proved to be particularly advantageous. With the halves in said angular position, the plug connector modules can be placed in a particularly easy manner into the holding frame. In the closed position, the halves assume an angle of approximately 180° or precisely 180° with respect to one another. The halves are therefore parallel to one another in the closed position.

The holding frame advantageously comprises a pivot point at each end, wherein the connecting line between the pivot points forms a rotational axis which extends parallel to the side faces of the halves. The halves of the holding frame can be rotated and aligned with respect to one another along the rotational axis. The pivot points are formed, as a rule, by a joint head which is guided in a matching joint receiving means and is described in more detail further below.

It is advantageous when a first half comprises at least one joint head and a second half comprises at least one joint receiving means (e.g., joint receiving cavity) which matches said joint head. The joint head of the first half is engageable in the joint receiving means of the second half, as a result of which a flexible connection between the halves is provided. The halves of the holding frame are alignable with respect to one another as a result of the flexible connection.

It is particularly advantageous when the first half comprises two joint heads which, as a rule, are arranged on the respective end faces of the first half. The second half comprises two joint receiving means which match said joint heads and in which the joint heads of the first half are engageable. Two end-side joints bestow mechanical robustness on the flexible connection.

In a particularly advantageous embodiment of the invention, a joint arm is integrally molded on the joint head or a joint arm is integrally molded on each of the joint heads. The joint arm is, or the joint arms are connected to the first half or are integrally molded thereon. A press lug is integrally molded in each case on the joint arm or on the joint arms.

In an advantageous manner, the second half comprises two recesses in the region or in the vicinity of the joint receiving means or in each case two recesses in the region or in the vicinity of the respective joint receiving means. The press lug is pressable into the two recesses or the press lugs are pressable into each of the two recesses, as a result of which the halves are fixable with respect to one another in at least two positions, an open position and a closed position. As a result, reliable fixing of the joint frame in two positions, the open and the closed position, is achieved. The technical means required for this are integrally molded directly on the halves of the joint frame such that the holding frame proposed here does not require any further components, in comparison with the prior art, and nevertheless provides further advantages. The solution proposed here can be realized in a simple and cost-efficient manner.

The above-described fixing works by way of a so-called oversize pressing and is consequently particularly reliable.

The halves preferably consist of a metal material. In a closed state, the halves are in electrically conducting contact with one another. As a result, the joint frame can also be used for earthing purposes.

In the case of embodiments of the present invention, the terms open or closed state and open or closed position are used synonymously.

BRIEF DESCRIPTION OF THE SEVERAL VIEWS OF THE DRAWINGS

An exemplary embodiment of the invention is shown in the drawings and is explained in more detail below. The drawings are as follows.

The figures include partially simplified, schematic representations. Sometimes, identical reference symbols are used for the same, but where applicable not identical elements. Various views of the same elements could be scaled differently.

DETAILED DESCRIPTION

Figure 1:
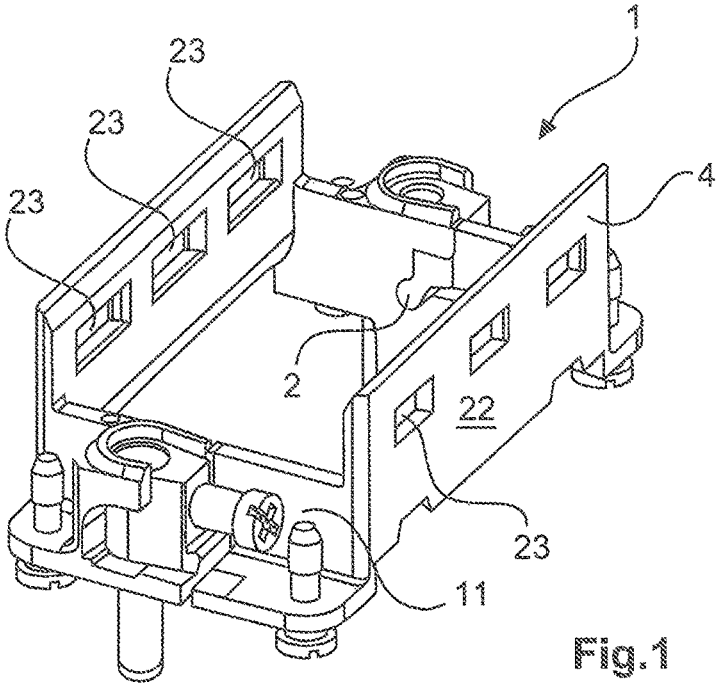
FIG. 1 shows a perspective representation of a holding frame.

FIG. 1 shows a holding frame 1 in a closed position. The holding frame 1 comprises or consists substantially of two halves 4, 5 which are interconnected by a joint 2, 3. One half 5 comprises, to this end, on the respective end faces, a joint head 2 which engages in a joint receiving means 3 (e.g., joint receiving cavity) of the oppositely situated half 4 provided for this purpose. This is known as a flexible connection between the two halves 4, 5 of the holding frame 1.

Figure 2:
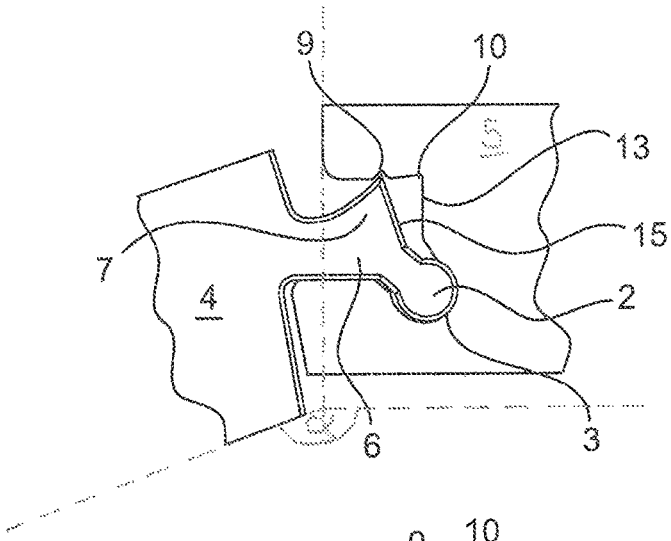
FIG. 2 shows a detail of a joint of a holding frame in an open position.

FIG. 2 shows two halves 4, 5, a first half 4 and a second half 5, of the joint frame 1, the longitudinal sides of the halves 4, 5 forming a separation plane. The individual halves 4, 5 are located in a plane which can assume various angular positions depending on the alignment of the halves 4, 5 with respect to one another. An angle $\alpha$ is defined by the intersection of the planes of the halves 4, 5.

The holding frame 1 in the open position means that the halves 4, 5 assume an angle $\alpha$ not equal to 180° with respect to one another. The angle is preferably between 130° and 170°. An angle between 155° and 165° has proved to be particularly advantageous. With the halves 4, 5 in said angular position, the plug connector modules 19 (FIGS. 6 and 7) can be placed in a particularly easy manner into the holding frame 1. With the holding frame 1 in the closed position, the halves 4, 5 assume an angle of approximately 180° or precisely 180° with respect to one another. The side faces 22 of the halves 4, 5 are therefore parallel to one another in the closed position.

Figure 3:
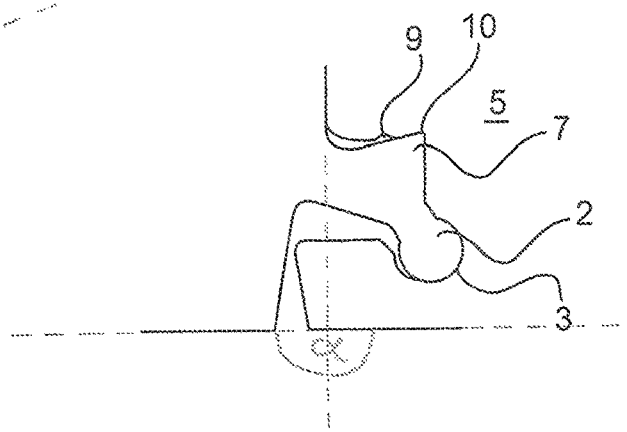
FIG. 3 shows a detail of a joint of a holding frame in a closed position.

FIGS. 2 and 3 show an enlarged detail in the region of a joint 2, 3 of the holding frame 1. The joint heads 2, 2' which are provided at the ends are integrally molded on the respective halves 4, 5 in each case by a joint arm 6, 6'. In each case, a so-called press lug 7, 7' is integrally molded on the respective joint arms 6, 6'. The joint head 2, the joint arm 6 and the press lug 7 together form approximately the shape of a flat cone.

The second half 5 of the holding frame 1 realizes in each case two recesses 9, 9, 10, 10' in the region of the flexible connection. All in all, four such recesses, each side includes two, are accordingly provided on the second half 5. The above-described press lugs 7, 7', which are integrally molded on the first holding frame 4, can engage in each of the two recesses 9, 9', 10, 10' or are pressable therein. As a result, the halves 4, 5 are fixable relative to one another in at least two positions, an open position (FIG. 2) and a closed position (FIG. 3).

Each end face 11, 12 of the holding frame 1 comprises two recesses, a first recess 9 and a second recess 10, in the region of the flexible connection. The above-mentioned press lugs 7, 7' can engage in the respective recess pairs 9, 10. If the press lugs 7, 7' are situated in the first recess 9, the holding frame 1 is fixed in the open position and can be fitted with plug connector modules 19. If the press lugs 7, 7' are situated in the second recess 10, the holding frame 1 is fixed in the closed position such that the plug connector modules 19 are no longer able to fall out and/or slip.

The open and closed position is secured in the holding frame 1 by stops. The second half 5 comprises a first stop 13 and a second stop 14 at each end. To this end, the joint frame 6 of the first half 4 comprises stops which correspond hereto, a first stop 15 and a second stop 16.

The above-mentioned stops are associated in each case with one half 4, 5 of the holding frame 1 and in each case, provide an end position in the alignment of the holding frame 1. If the first stop 13 of the second half 5 abuts against the first stop 15 of the first half 4, the holding frame 1 is thus situated in the closed state. If the second stop 14 of the second half 5 abuts against the second stop 16 of the first half 4, the holding frame 1 is thus situated in the open state or in the open position.

The holding frame 1 comprises a grounding plug socket 24 in which a pin (not shown) of an oppositely situated holding frame (not shown) is able to engage.

Figure 7:
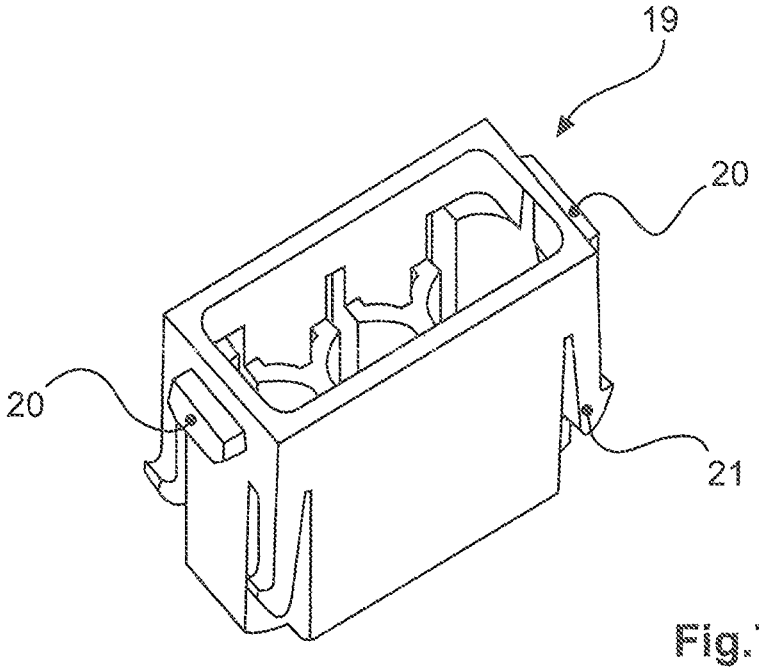

Plug connector modules 19 have been known for a long time and are described, for example, in DE 19 707 120 C1. The plug connector modules 19 are provided with protruding, approximately rectangular supporting means 20 and resilient latching hooks 21, as shown in FIG. 7. Recesses 23, which are realized as openings that are closed on all sides and into which the supporting means 20 enter when the plug connector modules 19 are inserted into the holding frame 1, are provided in the side parts 22 of the halves 4, 5.

Figure 4:
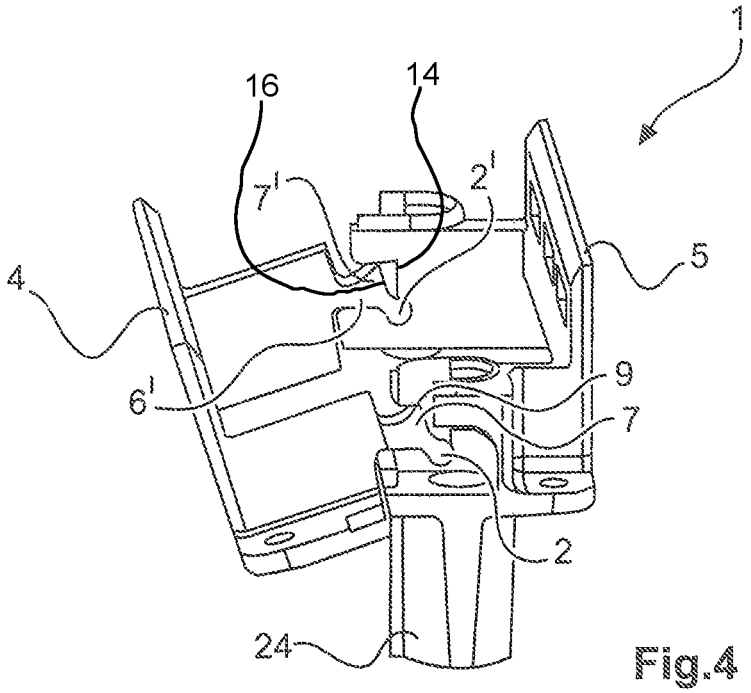
FIG. 4 shows a perspective representation of an open holding frame.

FIG. 4 shows the holding frame 1 in an open position. The end-side press lugs 7, 7' engage in the respective first recess 9, 9' of the second half 5. The holding frame 1 can be fitted with plug connector modules 19 (FIG. 7) in said position.

Figure 5:
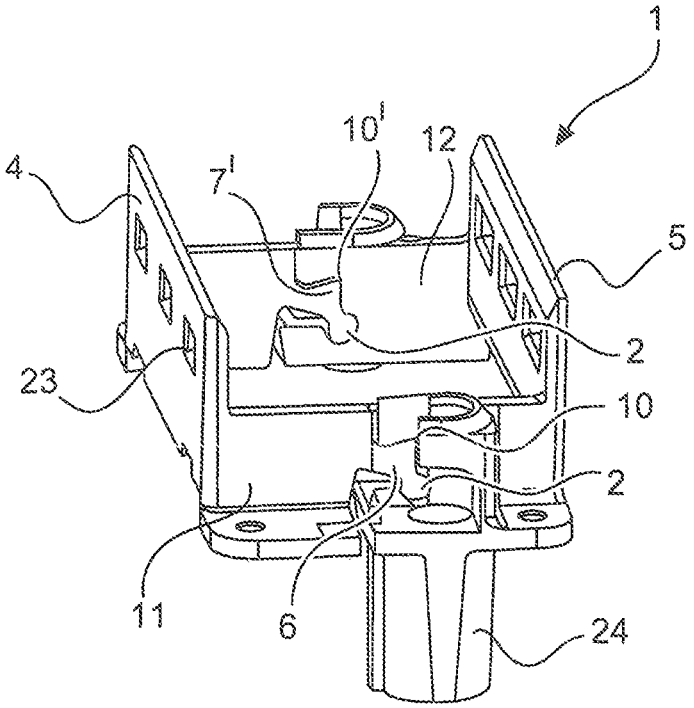
FIG. 5 shows a perspective representation of a closed holding frame.
Figure 6:
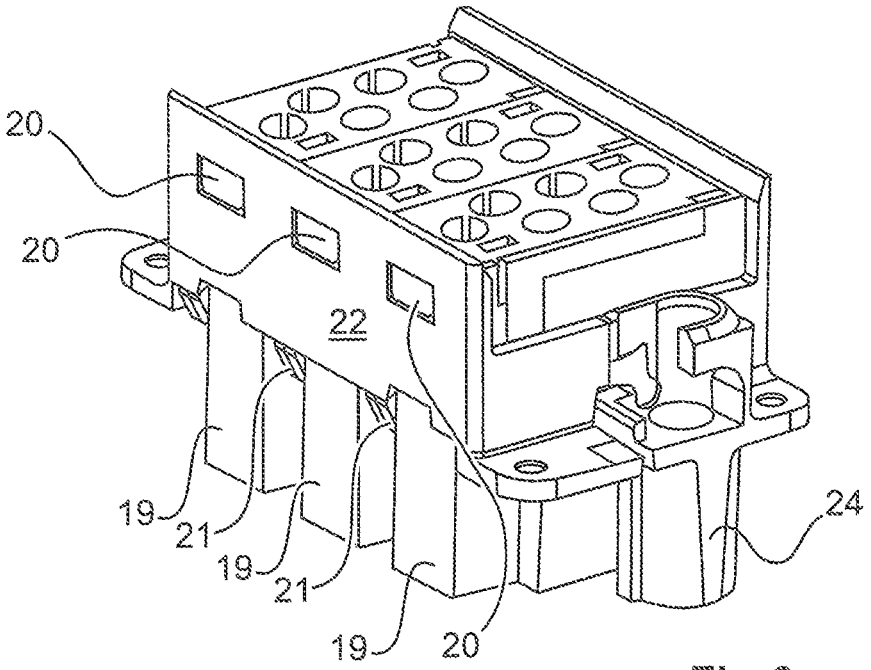
FIG. 6 shows a perspective representation of a holding frame fitted with plug connector modules and FIG. 7 shows a perspective representation of a plug connector module.

FIGS. 5 and 6 show the holding frame 1 in a closed position. The end-side press lugs 7, 7' engage in the respective second recess 10, 10' of the second half 5. In said position, the plug connector modules 19 installed in the holding frame 1 are no longer able to slip and/or fall out.

In the case of the exemplary embodiment shown here, a press lug 7, 7' is provided at each end of the holding frame 1, that is to say a total of two press lugs 7, 7'. However, providing a press lug 7 only on one end face 11 of the holding frame 1 and leaving the other end face 12 with a classic joint would also suffice.

Embodiments of the invention relate to a holding frame 1 into which plug connector modules 19 are insertable, the holding frame 1 comprising or consisting of two interconnectable halves 4, 5, the halves 4, 5 being alignable with respect to one another in at least two positions, the holding frame 1 comprising at least one fixing means or device and the halves 4, 5 being fixable with respect to one another in at least two positions by the at least one fixing means or device. At least one press lug 7, preferably however two press lugs 7, 7', is/are integrally formed on the first half 4. The second half 5 comprises two recesses 9, 10 on an end face 11 or in each case two recesses 9, 9', 10, 10' on both end faces 11, 12 and the press lug 7 is pressable into the two recesses 9, 10 or the press lugs 7, 7' are pressable into each of the two recesses 9, 9', 10, 10', as a result of which the halves 4, 5 are fixable with respect to one another in at least two positions, an open position and a closed position.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame into which plug connector modules are insertable, wherein the holding frame comprises two halves which are interconnectable in a flexible manner, a first half and a second half, wherein the halves are alignable with respect to one another in at least two angular positions, wherein the halves of the holding frame are fixable both in an open position and in a closed position, and wherein the holding frame comprises a pivot point at each end, and wherein a connecting line between the pivot points forms a rotational axis which extends parallel to side faces of the halves.

2. The holding frame as claimed in claim 1, wherein the first half comprises at least one joint head and the second half comprises at least one joint receiving cavity which matches said joint head, wherein the joint head of the first half is engageable in the joint receiving cavity of the second half and, as a result, a flexible connection between the halves is provided.

3. The holding frame as claimed in claim 2, wherein:

the first half comprises two joint heads which are arranged on respective end faces of the first half; and the second half comprises two joint receiving cavities in which the joint heads of the first half are engageable.

4. The holding frame as claimed in claim 2, wherein a joint arm is integrally molded on the joint head, and wherein the joint arm is connected to the first half.

5. The holding frame as claimed in claim 4, wherein a press lug is integrally molded on the joint arm.

6. The holding frame as claimed in claim 5, wherein:

the second half comprises at least one recess on an end face thereof; and the press lug is receivable in the at least one recess such that the halves are fixable with respect to one another in at least two positions, the open position and the closed position.

7. The holding frame as claimed in claim 6, wherein:

the second half comprises two recesses on the end face; and the press lug is receivable in the two recesses such that the halves are fixable with respect to one another in at least two positions, the open position and the closed position.

8. The holding frame as claimed in claim 6, wherein the press lug is pressable into at least one of the at least one recess.

9. The holding frame as claimed in claim 1, wherein the halves consist of a metal material and are in electrically conducting contact with one another in the closed position.

* * * * *